United States Patent [19]

Ueno

[11] Patent Number: 4,892,131

[45] Date of Patent: Jan. 9, 1990

[54] INJECTION APPARATUS OF DIE CAST MACHINES

[75] Inventor: Toyoaki Ueno, Yoshiki, Japan

[73] Assignee: Ube Industries, Ltd., Yamaguchi, Japan

[21] Appl. No.: 346,368

[22] Filed: Apr. 27, 1989

Related U.S. Application Data

[63] Continuation of Ser. No. 741,239, Jun. 4, 1985, abandoned, which is a continuation of Ser. No. 459,840, Jan. 21, 1983, abandoned.

[30] Foreign Application Priority Data

Jan. 26, 1982 [JP] Japan ..... 57-8202

[51] Int. Cl.[4] ..... B22D 17/10

[52] U.S. Cl. ..... 164/312; 164/113

[58] Field of Search ..... 164/113, 312, 313, 314, 164/315, 316, 317, 318, 319, 320, 321

[56] References Cited

U.S. PATENT DOCUMENTS 2,947,045 8/1960 Goldhammer ..... 164/303
4,347,889 9/1982 Komatsu et al. ..... 164/312

FOREIGN PATENT DOCUMENTS 2539280 3/1977 Fed. Rep. of Germany ..... 164/312

*Primary Examiner*—Richard K. Seidel
*Attorney, Agent, or Firm*—Charles E. Pfund

[57] ABSTRACT

A stationary board adapted to support a metal die and a frame adapted to support an injection cylinder are formed as an integral hollow structure. A sleeve teemed with molten metal extends through the board coaxially with the injection cylinder, and the molten metal in the cylinder is injected into the die by a plunger operated by the injection cylinder. With this construction, the weight of the apparatus is decreased and the rigidity can be increased. Further, not only centering of the injection cylinder is facilitated but also the length of the sleeve can be decreased.

5 Claims, 3 Drawing Sheets

INJECTION APPARATUS OF DIE CAST MACHINES

This is a continuation of application Ser. No. 741,239, filed on June 4, 1985 now abandoned (which is a continuation of U.S. Ser. No. 459,840, filed Jan. 21, 1983, now abandoned).

BACKGROUND OF THE INVENTION

This invention relates to injection apparatus of a die cast machine, and more particularly to an improvement of the mounting construction of the injection cylinder so as to increase the rigidity of a member for securing a die.

As shown in FIG. 1, a prior art injection apparatus of a die cast machine comprises a stationary solid board 1, a U shaped frame 2 secured to one side of the board 1 with bolts 3 and an injection cylinder 4 supported by the frame 2. The injection cylinder 4 includes an injection plunger 5 slidably extending through a sleeve 6 secured to the board 1. Although not shown, an opening for teeming molten metal is provided at an intermediate point of the sleeve 6 and the molten metal in the sleeve 6 is injected, under a predetermined pressure, into a die cavity formed at the interface of stationary and movable dies (not shown) when the injection plunger 5 is advanced by the injection cylinder 4, thus molding a die cast product.

With this prior art construction, since the frame 2 and the stationary board 1 are independently formed, unless the frame 2 is secured to the board 1 with high accuracy it becomes difficult to secure alignment of the cylinder 4. Moreover, it is necessary to increase the rigidity of the separate frame whereby not only its weight is increased but also mounting and dismounting of the frame 2 become difficult.

SUMMARY OF THE INVENTION

Accordingly, it is an object of this invention to provide improved injection apparatus of a die cast machine capable of eliminating all of the defects of the prior art construction described above.

More specific object of this invention is to provide an improved injection apparatus which is reduced in weight, capable of correctly aligning the injection cylinder, shortening the length of the injection sleeve, and increasing the rigidity of the injection apparatus.

According to this invention, there is provided injection apparatus of a die cast machine which comprises a stationary board adapted to support a die, a hollow frame integrally formed with the stationary board, an injection cylinder secured to a free end of the frame, a sleeve extending through the stationary board coaxially with the injection cylinder and provided with an opening for teeming molten metal into the sleeve, and a plunger actuated by the injection cylinder for injecting the molten metal in the sleeve into the die. The frame is provided with a plurality of openings to reduce the weight, to teem the molten metal or hang the injection apparatus and to discharge scale.

DESCRIPTION OF THE PREFERRED EMBODIMENT

Figure 1:
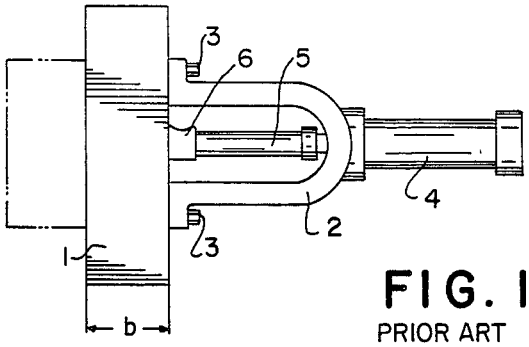
FIG. 1 PRIOR ART
FIG. 1 is a side view showing the prior art injection apparatus.
Figure 2:
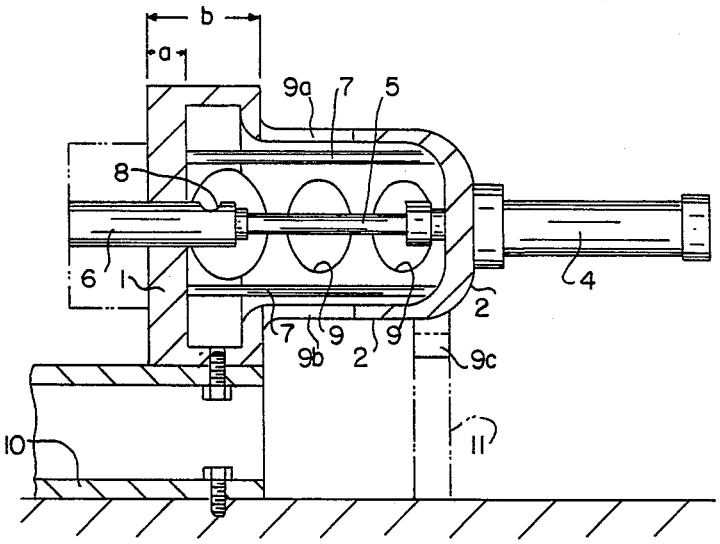
FIG. 2 is a longitudinal sectional view of one embodiment of this invention.

As shown in FIG. 2, according to this invention, the stationary board 1 and the frame 2 are integrally formed as a hollow structure, and the frame 2 is provided with a plurality of reinforcing ribs 7 on its inner surface. The stationary board 1 is fixedly mounted on a machine base 10 by means of bolts, for example, and the base machine is fixed to ground base.

The injection cylinder 4 is secured to the outer end of the frame 2 and the injection sleeve 6 extends through the relatively thin stationary board 1. Since the wall thickness of the hollow structure is made small, the stationary board 1 can also be made thin. Specifically, the stationary board 1 has the same height b as that of the prior art board but its solid thickness a is fairly reduced. As a consequence, it is possible to make short the sleeve 6 thus improving the injection condition. More particularly, a reduction in the longitudinal length of the sleeve 6 leads to the same amount of reduction in the longitudinal length of the plunger and the injection cylinder, so that the total reduction in the longitudinal length of the apparatus can be tripled. Also, due to the reduction in the longitudinal length of the sleeve, its area in contact with air and molten metal can be reduced and hence whirl of gas and partial solidification of the molten metal can be prevented to thereby maintain temperatures of the molten metal and keep the molten metal in good condition for injection, improving the injection condition. In addition to the above advantages, as the frame 2 and the stationary board 1 are made to be integral, no bolt is necessary to fabricate them and the stationary board 1 and hollow frame as a whole act as a mechanically strong member to increase the rigidity of the die securing member. Thus, it is only necessary to correctly align the injection cylinder 4 at the time of securing it to the frame 2. In other words, it is not necessary to correctly align the frame 2 at the time of securing it to the stationary board 1 in contrast to the prior art construction.

For teeming molten metal into the sleeve 6 through an opening 8, there are provided a plurality of relatively large openings 9 for the frame 2, thus decreasing the weight. Openings 9 facilitate exchange and repair of the plunger tip. of course, the configuration and the number of the openings 9 are determined in accordance with the mechanical strength of the frame 2. An upper opening 9*a* is provided for hanging the injection plunger, and a lower opening 9*b* is provided for discharging scale. A supporting member 9*c* is provided at the bottom of the frame 2. Preferably, the supporting member 9*c* is formed integrally with the frame 2 and in use of the apparatus, it is located on a support frame 11 as illustrated by phantom line in FIG. 2. Since the weight of the integrally formed stationary board 1 and the frame 2 has been reduced greatly, and since the deformation thereof is negligibly small, the injection apparatus can be strongly fixed to a stationary structure by the supporting member 9*c*. In the prior art construction, since the flexure of the apparatus is large, the frame was cantilevered with its free end floating, and a counterbalance device is provided for the frame. However, the flexure is made smaller in the present invention and the counterbalance device can be dispensed with and the member 9c can be employed. In an illustrative example in FIG. 2, three openings are provided but these openings may obviously merge into a large single opening.

Figure 3A:
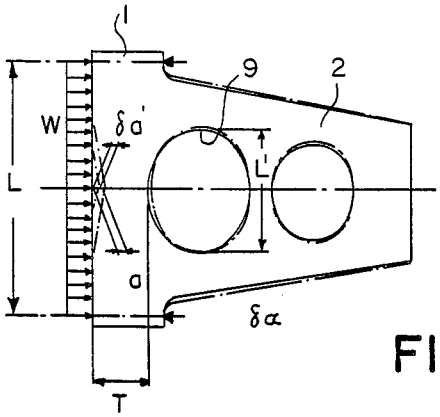
FIGS. 3*a* and 3*b* are diagrams useful to explain flexure.
Figure 3B:
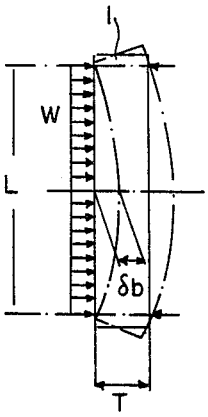
FIG. 3b PRIOR ART

FIG. 3a diagrammatically shows the flexure of the injection apparatus according to this invention, while FIG. 3b that of the prior art apparatus.

Although the flexure $\delta_a$ is extremely complicated, since the flexure $\delta_a$ of the frame is very small, it can be approximately expressed by the following equation:

$$\delta_a = \frac{WL^4}{384EI} \quad (1)$$

Actually, as it is possible to design L' the transverse diameter of opening 9 to be smaller than L, the value of $\delta_a$ can be made smaller than that calculated by equation (1). More particularly, because of the provision of an opening 9, it may be considered that the distance between fulcrums, L, is reduced to a diameter L' of the opening. Thus, for example, where L'=0.7 L, the value of flexure $\delta_a$ of the stationary board 1 can be calculated according to the following equation (2):

$$\delta'_a = \frac{W(L')^4}{384EI} = \frac{0.2401WL^4}{384EI} \quad (2)$$

of less than one-fourth the value of equation (1).

In the case of the prior art construction shown in FIG. 3b, the flexure $\delta_b$ of the stationary board 1 can be shown by the following equation (3).

$$\delta_b = \frac{5WL^4}{384EI} \quad (3)$$

In these equations

L: length of the board 1

L': diameter of the opening 9

T: thickness of the stationary board 1

$\delta_a$, $\delta'_a$, $\delta_b$: flexures of various portions

E: Young's modulus

I: sectional secondary moment

W: load acting on unit length of the stationary board.

In FIGS. 3a and 3b, solid lines show the apparatus where a load W is not applied, and dotted lines deformed configuration when load W is applied.

Since the stationary board 1 and the frame 2 are formed as a hollow integral structure, it is possible to make considerably thinner the stationary board 1 adapted to support a metal die than the prior art construction. This not only reduces the weight but also increases the rigidity and strength. Furthermore, centering of the frame is unnecessary. Shortening of the sleeve improves the casting condition. The fact that the flexure of the apparatus is much smaller than that of the prior art apparatus can be noted from FIGS. 3a and 3b and equations (2) and (3). When the diameter of the frame 2 is equal to L and when openings 9 are not provided, the ratio of flexures of this invention and the prior art construction is approximately equal to 1/5. Furthermore, where L'=0.7 L, and openings 9 are formed, the ratio of flexures becomes 1/20 to 1/30 meaning that the rigidity is increased greatly according to this invention.

Figures 4A, 4B:
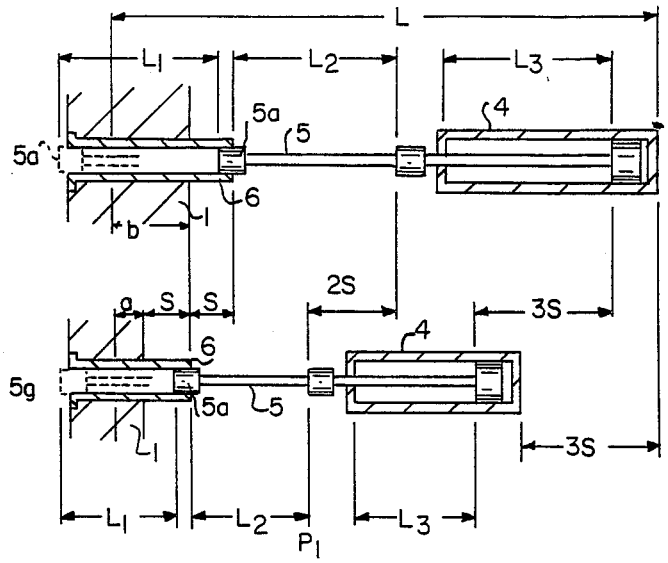
FIG. 4a PRIOR ART
FIGS. 4A and 4B diagrammatically compare the dimensional differences between the prior art and the structure of the instant invention.

FIGS. 4A and 4B diagrammatically depict the dimensional differences between the prior art and the apparatus of the instant invention. Referring thereto, FIG. 4A illustrates a structure wherein the frame and the stationary board are not unitary and the thickness of the stationary board for securing the injection sleeve is excessive, requiring a long sleeve which adversely affects injection molding. When the sleeve is slender and long as shown in FIG. 4A, the surface area of the molten metal in contact with the sleeve is large, thus contributing to lowering the temperature of the molten metal which, in turn, tends to create a larger and thicker solidified layer. When the solidified layer is long, it is apt to break into pieces at the time of the injection as the plunger tip moves ahead and mingle with the molten metal. If the broken pieces of the solidified layer enter a die cavity along with the molten metal, the strength and quality of the molded product will be degraded. The lowering of the temperature of the molten metal also makes it difficult for the molten metal to fill the cavity completely at the time of injection and degrades the quality of the product. The surface area in contact with the air is large, which not only lowers the temperature of the molten metal, but also entrains much of the air in the upper portion of the sleeve at the time of injection and tends to form an oxide film which further contributes to preventing the manufacturing of high quality product without defects.

According to the instant invention as illustrated in FIG. 4B, because the sleeve is short, the solidified layer formed with the portion of the metal in contact with the sleeve will not break into pieces at the time of injection. It is compressed and crushed between the die and the advancing plunger tip. Further, the plunger tip stops short of the die by about 30 millimeters so that, for example, upon completion of the injection, a biscuit is formed, but since the crushed solidified layer remains absorbed in the biscuit, product is not adversely affected. Naturally, when the sleeve is shorter, the lowering of the temperature and the inclusion of air are reduced sufficiently so that the manufactured product can be produced without defects. Thus, the shorter the sleeve, the better the product. The instant invention was made to take advantage of this as will now be explained.

When the stationary board is thin and the sleeve is short, the entire apparatus can be short and compact for faster operation. When the thickness of the stationary board is less by S:

(a) The stroke l1 of the plunger tip 5a in the injection sleeve mounted on the stationary board can be shorter by S.

(b) The distance l2 between the position $P_1$ of the rear end of the plunger fully retreats and the rear end of the injection sleeve can be shorter by S.

(c) The stroke l3 of the injection cylinder can be shorter by S.

Thus, the distance L between the die fixture surface of the stationary board and the rear surface of the injection cylinder can be shorter by 3S which is the sum of the amounts S in (a), (b) and (c).

What is claimed is:

1. An injection apparatus mounted for operation with substantially horizontal stroke and comprising a support for an injection sleeve, injection cylinder and an injection plunger structured to support the injection plunger in concentric, non-deviating alignment with the injection sleeve and the injection cylinder, said support comprising a rigid end plate, a rigid flange bounding the end plate and perpendicular thereto, a rigid frame of lesser diameter than said flange concentric with the flange and flared to extend to join said flange, said frame embodying an end wall spaced from and parallel to the end plate, said end plate and said end wall containing concentric aligned openings, said injection sleeve fixed in the opening in the end plate, said injection cylinder fixed in the opening in said end wall and containing a piston and a piston rod extending therefrom through said opening in the end wall, said piston rod being connected at its distal end to the plunger in the injection sleeve, said flange being of substantially greater axial length than the axial thickness of the end plate such as to impart rigidity to the end plate to provide for minimum thickness of the end plate and minimal length of the injection sleeve while maintaining alignment between the injection sleeve and the injection plunger and wherein said end plate, flange, frame, and end wall constitute a unit formed as an integral one-piece structure and wherein said frame effectively reduces the bending span of said end to thereby reduce bending deflection due to injection pressure on the face of said end plate.

2. Apparatus according to claim 1 comprising supports at the opposite ends of the frame.

3. Apparatus according to claim 1 wherein the injection sleeve contains an opening at the upper side for receiving molten metal and said frame contains an opening affording access to said opening in the sleeve and wherein there is an opening in the frame below the injection sleeve which provides for removal of dross.

4. A structure according to claim 1 wherein there are symmetrically arranged reinforcing ribs integral with the interior of the frame extending from the end wall to the end plate.

5. Apparatus according to claim 1 wherein said frame has opposed genrally circular openings which extend a substantial distance between the flared portion of said frame.

* * * * *